United States Patent [19]

Suzuki

[11] 4,402,446

[45] Sep. 6, 1983

[54] TAG-PIN ATTACHING APPARATUS

[75] Inventor: Tadashi Suzuki, Saitama, Japan

[73] Assignee: Satogosei Co., Ltd., Tokyo, Japan

[21] Appl. No.: 251,923

[22] Filed: Apr. 7, 1981

[30] Foreign Application Priority Data

Sep. 1, 1980 [JP] Japan ..... 55-120813

[51] Int. Cl.[3] ..... B65C 5/06

[52] U.S. Cl. ..... 227/67; 226/55; 226/56

[58] Field of Search ..... 29/241, 417, 429, 433, 29/451; 226/55, 56, 57, 58, 62, 63, 64, 67; 227/67, 120, 119, 97

[56] References Cited

U.S. PATENT DOCUMENTS

| | | | |
|---|---|---|---|
| 3,081,013 | 3/1963 | Walther | 226/64 |
| 3,103,666 | 9/1963 | Bone | 227/67 X |
| 3,103,666 | 9/1963 | Bone | 229/67 |
| 3,735,908 | 5/1973 | Kinney et al. | 227/67 |
| 3,858,969 | 1/1975 | Wernick | 226/63 X |
| 3,880,339 | 4/1975 | Bone | 227/67 X |
| 3,910,324 | 10/1975 | Nasiatka | 226/62 X |
| 4,187,970 | 2/1980 | Furutu | 227/67 X |

FOREIGN PATENT DOCUMENTS

| | | | |
|---|---|---|---|
| 2113664 | 10/1971 | Fed. Rep. of Germany | 226/62 |
| 47-23999 | 7/1972 | Japan . | |
| 54-63949 | 5/1979 | Japan . | |

*Primary Examiner*—Paul A. Bell

*Attorney, Agent, or Firm*—Mason, Fenwick & Lawrence

[57] ABSTRACT

A locking piece fitter of a pistol type wherein a guide needle is inserted and fitted in the tip, a push-in rod is contained, a supporting base having a supporting groove and push-in rod guiding hole coaxially aligned with the guide needle and push-in rod is arranged between the guide needle and push-in rod, a feeding groove in which a locking piece assembly can be fitted and inserted is provided above the supporting groove of the supporting base, flexible locking pawls engaging with the lateral rod of the locking piece are arranged in the feeding groove and the locking pawls are provided on a rising and falling base which can be made to rise and fall by a push-in rod mover moving together with the push-in rod and a spring. A spring and stopper are attached to a guide needle inserting depth adjusting member of the fitter and flexible pressing pieces pressing the lateral rod of the locking piece are provided in the feeding groove.

2 Claims, 16 Drawing Figures

TAG-PIN ATTACHING APPARATUS

TECHNICAL FIELD

This invention relates to a tag-pin attaching apparatus to be used for bundling or labeling clothing and other fiber products.

DISCLOSURE OF PRIOR ARTS

Such tag-pin attaching apparatus are already known through the specification of U.S. Pat. No. 3,103,666 and the Publication of Japanese Utility Model Publication No. 23999/1972.

The tag-pins for bundling clothing or the like or attaching such labels as price tags used in such known fitter are formed as an assembly in which synthetic resin moldings each formed by connecting a head part 1*a* and a lateral rod 1*b* through a filament 1*c* in such tag-pin 1 as is shown schematically in FIG. 12A have generally many lateral rods 1*b* connected through connecting parts at a proper pitch by one connecting rod performing the function of a feeding guide.

Further, in the one mentioned in the publication of Japanese Patent Laid Open No. 63949/1979, a tag-pin assembly by a connection different from the above and a fitter to be used for it are disclosed.

In such fitters, the above mentioned locking piece assembly is inserted and fitted in the tag-pin attaching apparatus and the locking pieces 1 are locked to clothing or the like one by one while cutting off the above mentioned connecting parts.

By the way, the connecting rods and connecting parts so called here indicate such members as the assembling rod 35 and neck 36 in the above mentioned U.S. Pat. No. 3,103,666 and the base plate 9 and connecting part f in the above mentioned Japanese utility model though not shown in FIG. 2 and in general are schematically shown in FIG. 12A as a connecting rod 28 and connecting parts 29. As described later, the present invention is a tag-pin attaching apparatus in which can be used not only the locking piece assembly having such form but also the locking piece assembly 1X of FIG. 2 having connecting rods 30 shown in FIG. 12B, differ from the above combined form of the connecting rods and connecting parts.

Now, the pitch between the respective tag-pins of the conventional assembly is not always constant but often varies depending on the manufacturer. In most cases, the tag-pins could not be used in common in the general conventional pin attaching apparatus.

SUMMARY OF THE INVENTION

The present invention has it as an object to provide a tag-pin attaching apparatus wherein, by a simple structure, even if the pitch of the tag-pin assembly is irregular or its form is more or less different, the locking pieces will be able to be accurately fitted one by one and the operating efficiency will be able to be improved.

The tag-pin attaching apparatus of the present invention of a pistol type having a grooved needle inserted and fitted in the tip and containing a pin or driving rod to push the transverse bar of a tag-pin into this grooved needle is characterized in that a supporting base having a supporting groove and pin or driving rod guiding hole coaxially aligned with the above mentioned grooved needle and pin or driving rod is arranged between the above mentioned grooved needle and pin or driving rod, a feeding groove in which a tag-pin assembly can be fitted and inserted is provided above the supporting groove of the above mentioned supporting base, flexible locking pawls engaging with the transverse bar of the tag-pin are arranged in this feeding groove, these pawls are provided on a feeding member having a projection and always pressed downward by a spring, this rising and falling base is so made as to rise and fall by a piston moving together with the above mentioned pin or driving rod through the above mentioned projection and a grooved needle inserting depth adjusting member is attached to the above mentioned grooved needle inserting and fitting part.

A spring and stopper can be attached to the grooved needle inserting depth adjusting member of the apparatus of the present invention and a flexible pressing piece pressing the lateral rod of the locking piece can be provided in the above mentioned feeding groove.

DETAILED DESCRIPTION OF THE INVENTION

Figure 1:
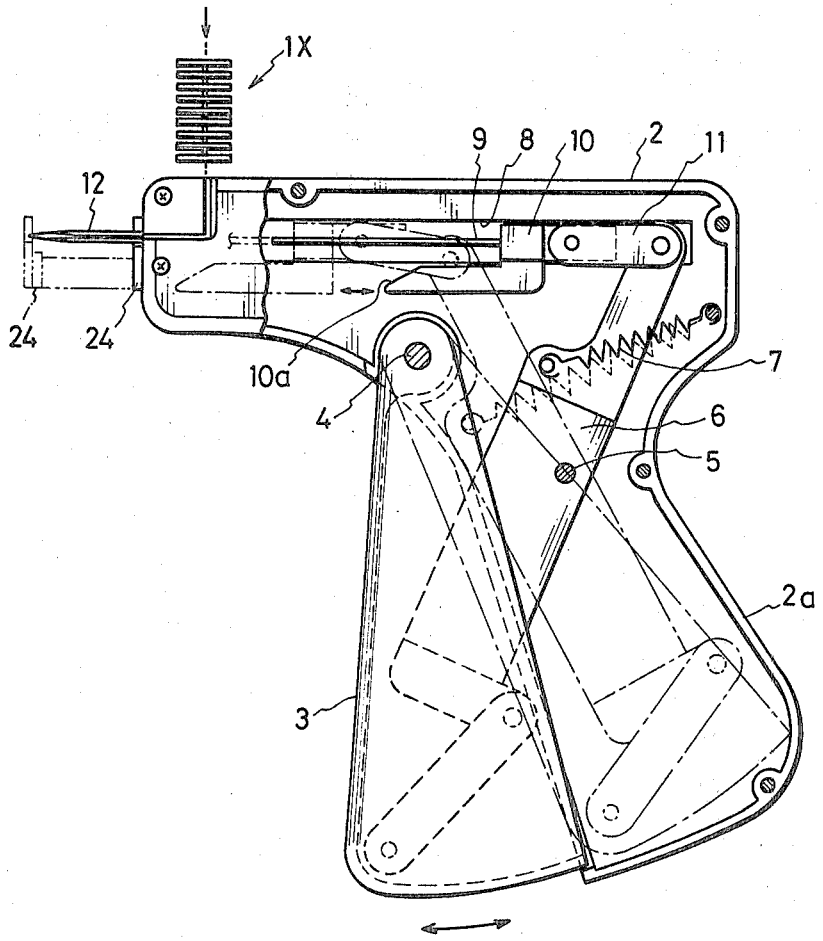
FIG. 1 is a side view of an embodiment of the present invention.

The present invention shall be described more particularly in the following with reference to the drawings.

A body 2 is pistol-shaped and is divided into two parts 2*a* and 2*b* near the center in the thickness direction and such respective mechanisms as are illustrated are assembled in one part and are covered with the other part of the body so as to be fixed. A lever 3 is connected so as to be operated in the directions indicated by the arrows with a lever fulcrum 4 as a fulcrum on the front side of a gripped part 2*a*. An actuating link 6 rocking in association with the lever 3 with a link fulcrum 5 provided in the gripped part 2*a* of the body 2 as a fulcrum is arranged inside this lever 3. Further, the rear side wall within the body 2 and the actuating link 6 are connected with each other through a tension spring 7 so that the lever 3 and actuating link 6 may be always held in the solid line positions in FIG. 1 by this spring 7.

A guide groove 8 is formed in the horizontal direction indicated by the arrow in the upper part within the body 2. A piston 10 provided with a pin or driving rod 9 at the tip is slidably fitted and inserted in this guide groove 8 and is connected with the above mentioned actuating link 6 and an intermediate link 11 so as to be slid within the guide groove 8 by the actuating link 6 and intermediate link 11 with the operation of the lever 3.

A grooved needle 12 is removably inserted and fitted in the tip of the body 2 positioned on the extension of the axis of the rod 9. A supporting base 23 having a groove 21 supporting the transverse bar 1*b* of the tag-pin 1 and a guiding hole 22 for the rod 9 as coaxially aligned with the above mentioned guide needle 12 and rod 9 is provided between this guide needle 12 and rod 9. A feeding groove 13 in which is fitted and inserted a locking piece assembly 1X intersecting substantially at right angles with the axis of the guide needle is formed above the above mentioned supporting groove 21.

Figure 2:
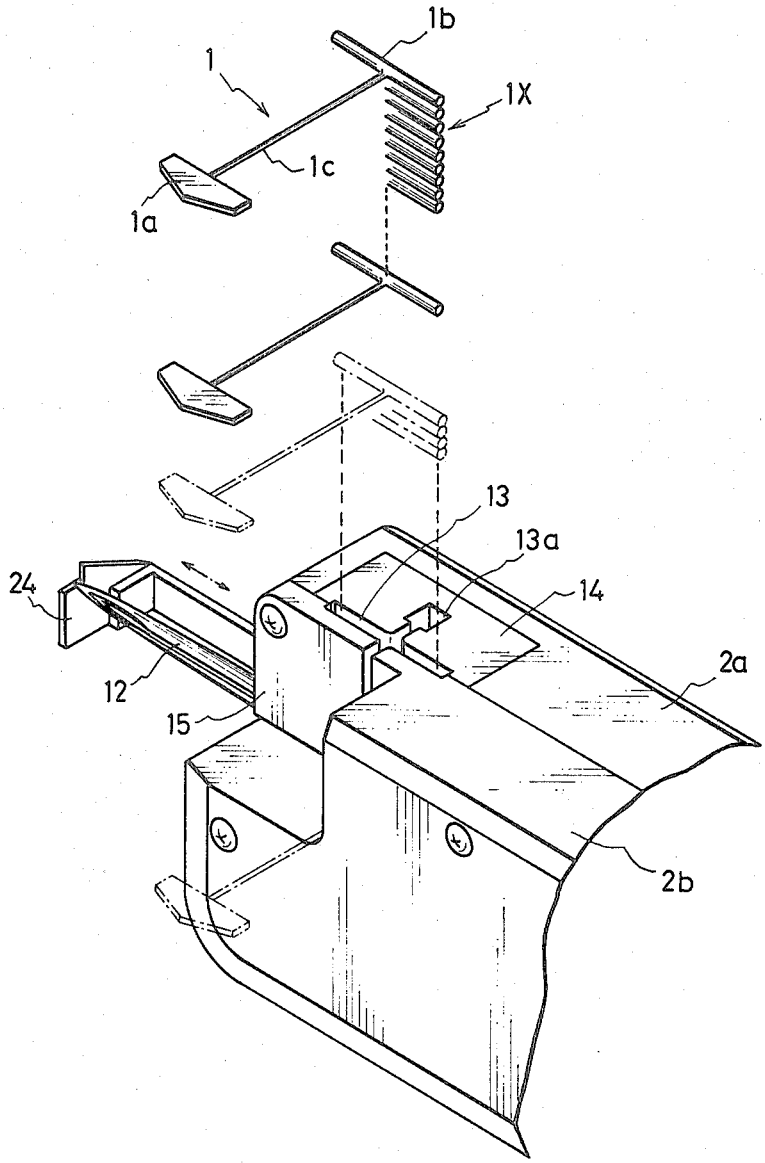
FIG. 2 is a partial perspective view.
Figure 3:
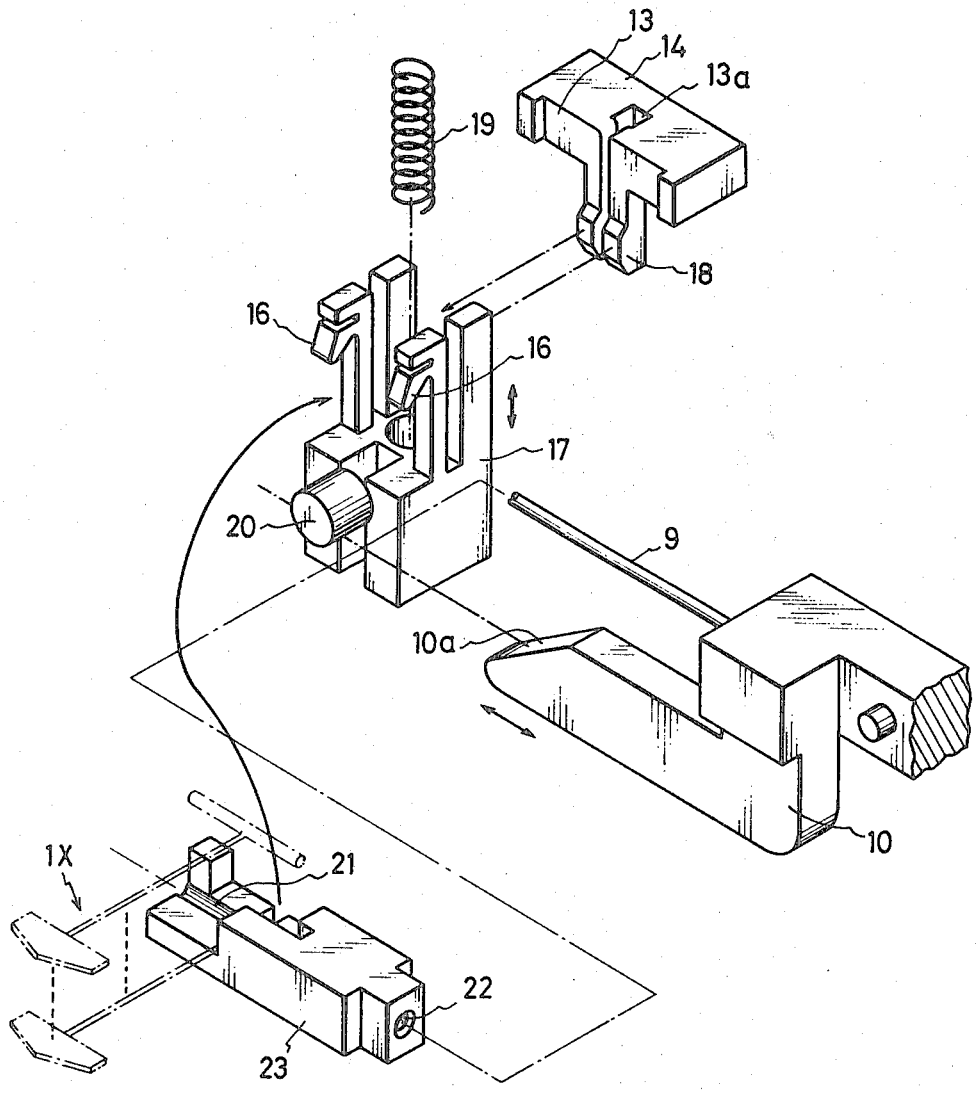
FIG. 3 is a detailed assembly view of the vicinity of a feeding groove.
Figure 4:
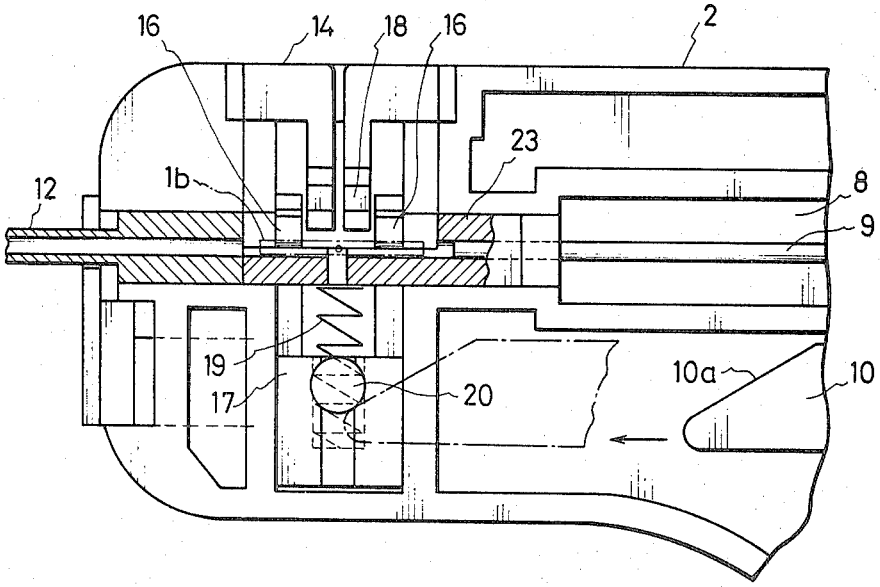
FIGS. 4 and 5 are sectional partial side views.

As in the embodiment illustrated in FIG. 2, the feeding groove 13 is formed of a part 14 provided with the feeding groove 13 on one side surface and a cover 15. Flexible locking pawls 16 engaging with the lateral rod 1*b* of the tag-pin 1 are arranged within this feeding groove 13. For example, as in the embodiment illustrated in FIG. 3, the locking pawls 16 may be provided on a rising and falling base 17. Further, flexible pressing pieces 18 molded integrally with the part 14 lightly pressing the lateral rod 1*b* of the tag-pin 1 to the cover 15 side may be present within the feeding groove 13.

By the way, 13*a* is an auxiliary groove which is formed in the feeding groove 13 and is to be utilized in the case of fitting the conventional tag-pin assembly having the connecting part as described above.

The feeding member 17 is provided with a spring 19 so as to be always pressed downward and also with a projection 20. These part 14, feeding member 17 and supporting base 23 are combined as in the embodiment shown in FIG. 3 so that the feeding member 17 may be made to rise and fall through the projection 20 by a slope cam 10*a* formed on the front part of the mover 10 with the movement of the push-in rod mover 10.

Figure 9:
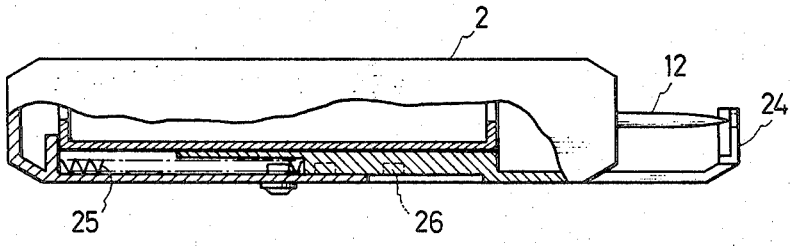
FIG. 9 is a partly sectioned plan view.
Figure 10:
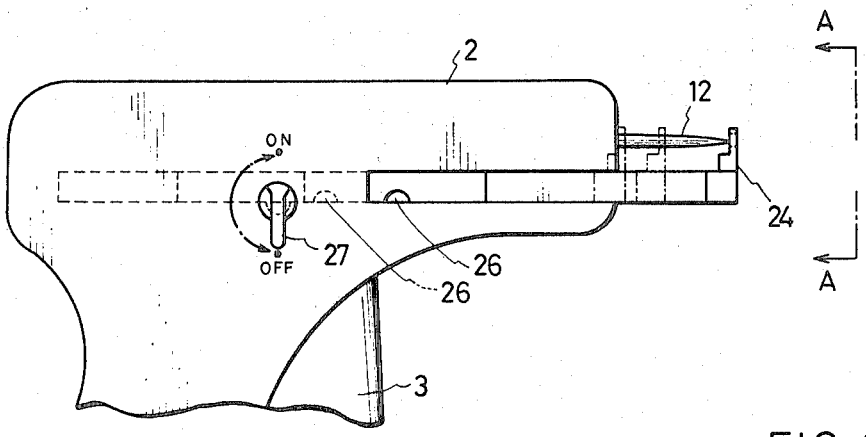
FIG. 10 is a partial side view.
Figure 11B:
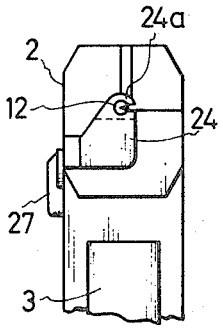
FIG. 11 is a view seen in the direction indicated by the arrows A—A in FIG. 10.
Figure 11A:
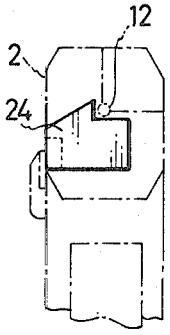

Furthermore, a grooved needle 12 inserting depth adjusting member 24 is attached to the tip of the body 2 fitted with the above mentioned grooved needle 12. This inserting depth adjusting member 24 is attached to the upper side surface of the body 2 as shown in FIGS. 9 to 11 and is always slightly projected out of the tip of the grooved needle 12 so as to be placed in a safe state for the needle as shown in FIGS. 1, 2, 9 and 10. Semicircular cuts 26 can be made at proper intervals in the base of the inserting depth adjusting member 24 and a stopper 27 disengageable with these cuts 26 can be provided in the body 2.

In FIG. 11, instead of the formation in A, in order to more positively hold the grooved needle 12, as in B, the tip position 24*a* may be formed to be partly cut circular.

Figure 12A:
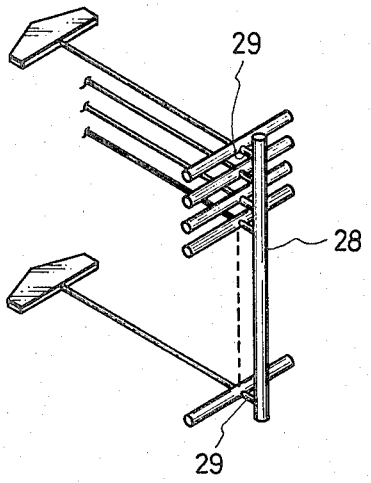
Figure 12B:
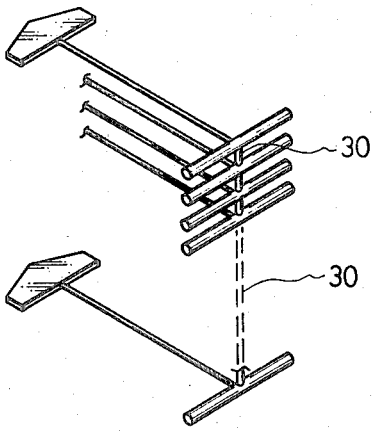

Such tag-pin assembly 1 X as is shown in FIG. 2 is used in the apparatus of the present invention. The tag-pin assembly 1 X is formed to be an assembly wherein synthetic resin moldings each made by connecting the head part 1*a* and lateral rod 1*b* of the tag-pin 1 through a filament 1*c* have many lateral rods 1*b* connected at a proper pitch by one connecting rod 30 performing the function of a feeding guide, shown in FIG. 12B. However, according to the present invention, not only the above mentioned tag-pin assembly 1 X is used but also the known conventional tag-pin assembly as shown in FIG. 12A connected to the connecting rod through the connecting parts can be used by utilizing the auxiliary groove 13*a*.

The above mentioned tag-pin assembly 1 X is fitted and inserted in the feeding groove 13, the lateral rod 1*b* of the lowermost tag-pin is supported by the groove 21 of the supporting base 23 and the feeding depth adjusting member 24 is contracted as shown by the chain line in FIG. 10, is fitted to the thickness of the clothing or any other article for the grooved needle 12 inserting length and is fixed in the position by the stopper 27.

After the grooved needle 12 is inserted into the article, when the lever 3 is operated as gripped, the piston 10 will be moved leftward in FIG. 1 by the actuating link 6 and intermediate link 11, the rod 9 will pass through the guide hole 22, will contact and push the transverse bar of the tag-pin supported on the supporting base, will cut and separate it from the assembly, will guide it into the needle 12 and will pass it through the article so that the tag-pin 1 may be locked with the article.

Figure 5:
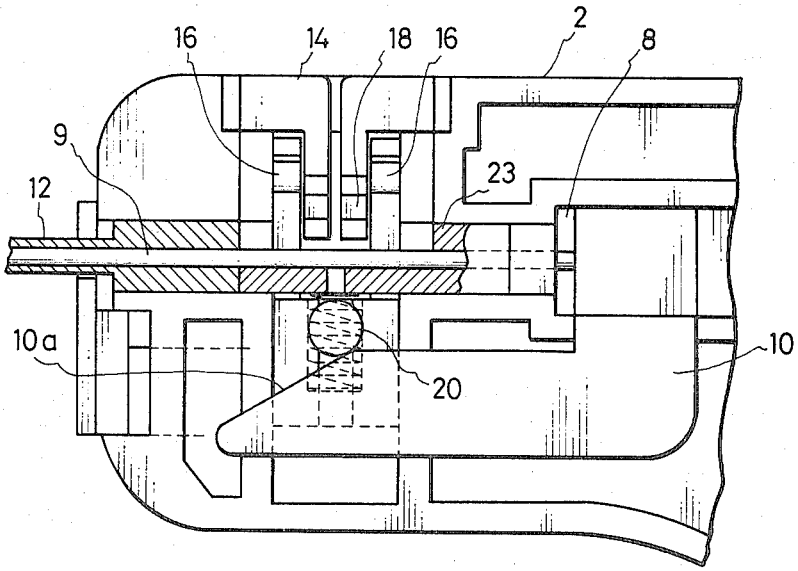
Figure 6A:
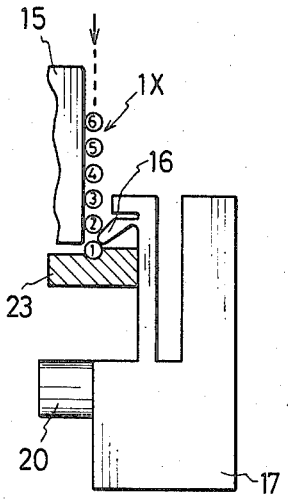
FIGs. 6 to 8 are operation explaining views.
Figure 6B:
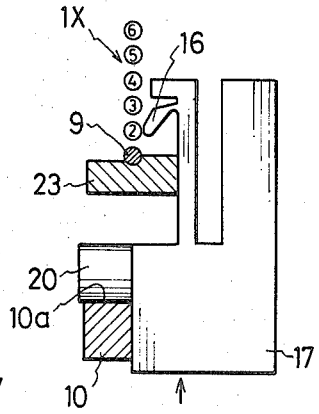
Figure 6C:
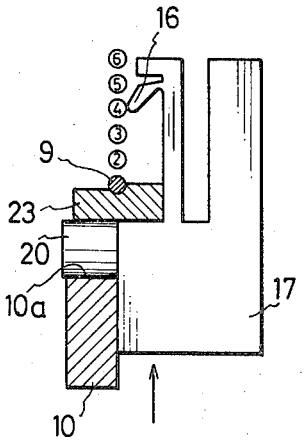

In the case of the present invention, the separating operation can be smoothly made without requiring to provide such cutter mechanism as in the conventional apparatus. Now, simultaneously with the above mentioned operation, as shown in FIG. 5, the slope cam 10*a* part of the piston 10 will push up the projection 20 of the rising and falling base 17 and the base 17 will rise. When the lever 3 is then released, contrary to the above, the piston 10 will be retreated by the resiliency of the spring 7, the rising and falling base 17 will fall, therefore the locking pawls 16 will engage with another tag-pin and will lower it and the lateral rod of the lowermost tag-pin will be supported on the supporting base 23. That is to say, as in FIG. 6A, first the tag-pin assembly will be fitted and inserted in the feeding groove 13, the lowermost transverse bar will be supported by the supporting base 23 and will be guided into the guide needle 12 by the pushin rod 9 and, at the same time, with the movement of the piston 10, the feeding member 17 will rise through the projection 20 as its variation is shown in FIGS. 6B to 6C. At this time, the locking pawls 16 will also rise substantially without such resistance to the tag-pin. However, when the fitting of one tag-pin ends and the piston 10 retreats as mentioned above, the feeding member 17 will fall, the locking pawls 16 will fall as engaged with the transverse bar and therefore the lowermost transverse bar will be supported on the supporting base 23 so as to be ready for the next fitting.

Figure 6D:
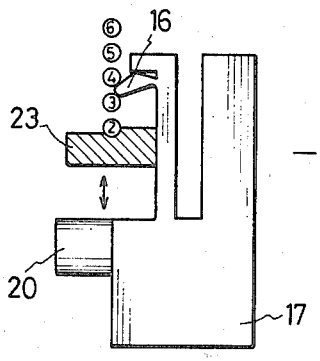
Figure 6E:
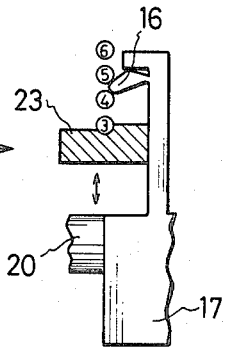
Figure 7:
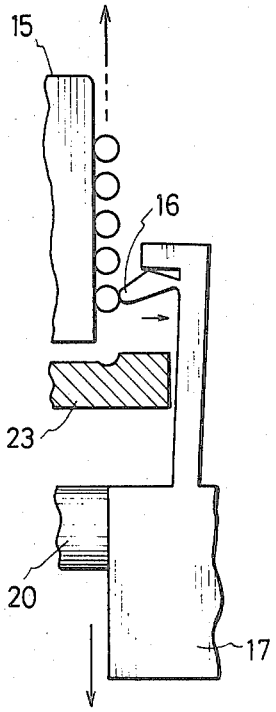
Figure 8:
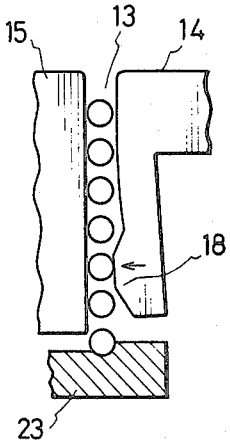

Thus, thereafter, the repeated operations of FIGS. 6C and 6D will be made (See FIG. 6E) and the tag-pins will be fitted to the articles in turn. However, as the locking pawls 16 are flexible, as shown in FIG. 7, when not required, the tag-pin assembly can be simply pulled off with fingers in the direction indicated by the arrow to be arranged and stored. Further, if the pressing pieces 18 of the part 14 are present in the feeding groove 13, as shown in FIG. 8, the lateral rods of the tag-pin assembly will be able to be positively held in a line and the work will be able to be carried out efficiently and pleasantly without any mis-operation in fitting the locking piece.

As described above, the present invention has such many practically advantageous effects that, even if the tag-pin assembly is irregular in the pitch or more or less different in the connecting system, the tag-pins will be able to be accurately fitted one by one, the tag-pin assembly will be able to be easily inserted into or removed out of the feeding groove, the grooved needle inserting length will be able to be adjusted in response to the thickness of the article and the safety measures for the grooved needle when not used need not be considered.

I claim:

1. In an apparatus for attaching a tag-pin having a pistol-shaped body; a lever supported on said body for rocking movement; a driving rod attached to a piston driven by means of said lever for pushing a transverse bar of tag-pin; a trigger-like lever means directly driving said piston; a feeding mechanism of a tag-pin assembly; a grooved needle provided at one end of said pistol-shaped body, said rod being located for movement on the axis of said needle; and an adjusting means removably attached at the forward portion of said pistol-shaped body to adjust the length of insertion of said grooved needle into an article, the improvement comprising; said piston being provided with a projection having a slope; and a feeding mechanism for inserting tag-pins including a feeding member biased downward by a spring, said feeding member being provided with projections having flexible pawls, a wall member provided with a flexible passing portion for pressing tag-pins toward opposite wall member of feeding hole, and a supporting member provided with a groove supporting the transverse bar of the tag-in and guiding hole for said driving rod, said feeding member being forced up and down by the movement of said piston through the slope of said projection of said piston, and said pawls forcing down the tag-pin assembly to locate the lowest transverse bar of said tag-pin assembly into the groove of said supporting member.

2. A locking piece fitter according to claim 1 wherein said guide needle inserting depth adjusting member is biased by a spring so as to come to the tip of the guide needle and is provided with a stopper which can adjust its length.

* * * * *